US005253873A

United States Patent [19]

Grattan

[11] Patent Number: 5,253,873

[45] Date of Patent: Oct. 19, 1993

[54] VARIABLE FORCE PROJECTOR AND CATCHER

[76] Inventor: Donald Grattan, 4156 N. Paulina, Chicago, Ill. 60613

[21] Appl. No.: 910,707

[22] Filed: Jul. 8, 1992

[51] Int. Cl.[5] ..... F41B 7/00

[52] U.S. Cl. ..... 273/324; 124/16; 124/37; 124/40

[58] Field of Search ..... 273/324, 72, 69; 124/16, 37, 38, 40, 41.1

[56] References Cited

U.S. PATENT DOCUMENTS

| | | | |
|---|---|---|---|
| 689,586 | 12/1901 | Haskell | 273/69 |
| 1,615,266 | 1/1927 | French | 273/324 |
| 2,335,881 | 12/1943 | Persinger | 42/15 |
| 2,917,038 | 12/1959 | Handley | 124/37 |
| 3,026,644 | 3/1962 | Raider | 124/38 |
| 3,236,521 | 2/1966 | Knott | 273/72 R |
| 3,246,895 | 4/1966 | Trail | 124/38 |
| 3,329,428 | 7/1967 | Moran | 124/16 |
| 3,393,911 | 7/1968 | Lawson | 273/428 |
| 3,765,396 | 10/1973 | Keinholz | 124/41.1 |
| 3,897,061 | 7/1975 | Grattan | 273/324 |

*Primary Examiner*—William H. Grieb

*Attorney, Agent, or Firm*—Fitch, Even, Tabin & Flannery

[57] ABSTRACT

A spring-operated plunger type ball shooter is disclosed having a ball catcher and holder at one end and a twist grip trigger at the other end. The shooter is designed for the playing of games and includes a gravity actuated elevation indicator and a spring force indicator to increase the fun and accuracy of shooting. The shooter is provided with a trigger assembly along the barrel and a safety catch to hold the plunger rod in its cocked position.

6 Claims, 4 Drawing Sheets

FIG.6
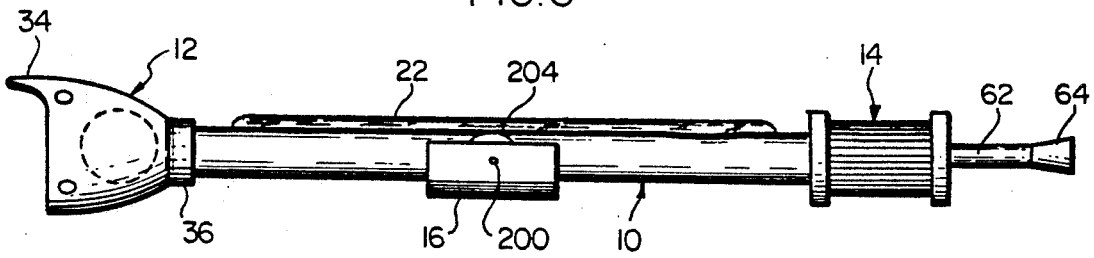
FIG.7
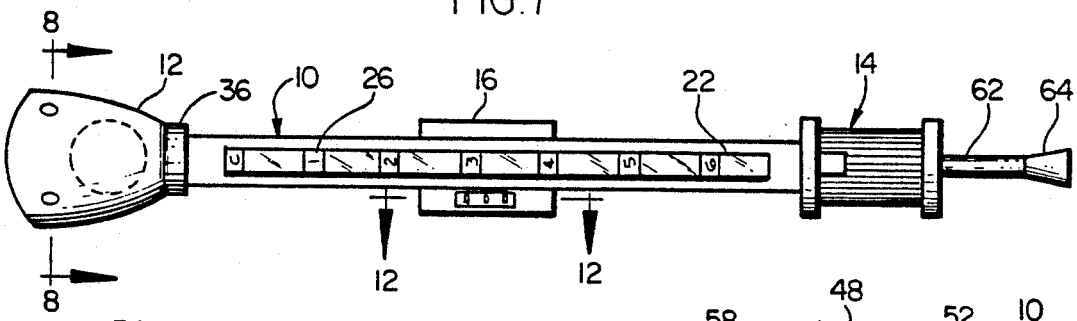
FIG.8
FIG.9
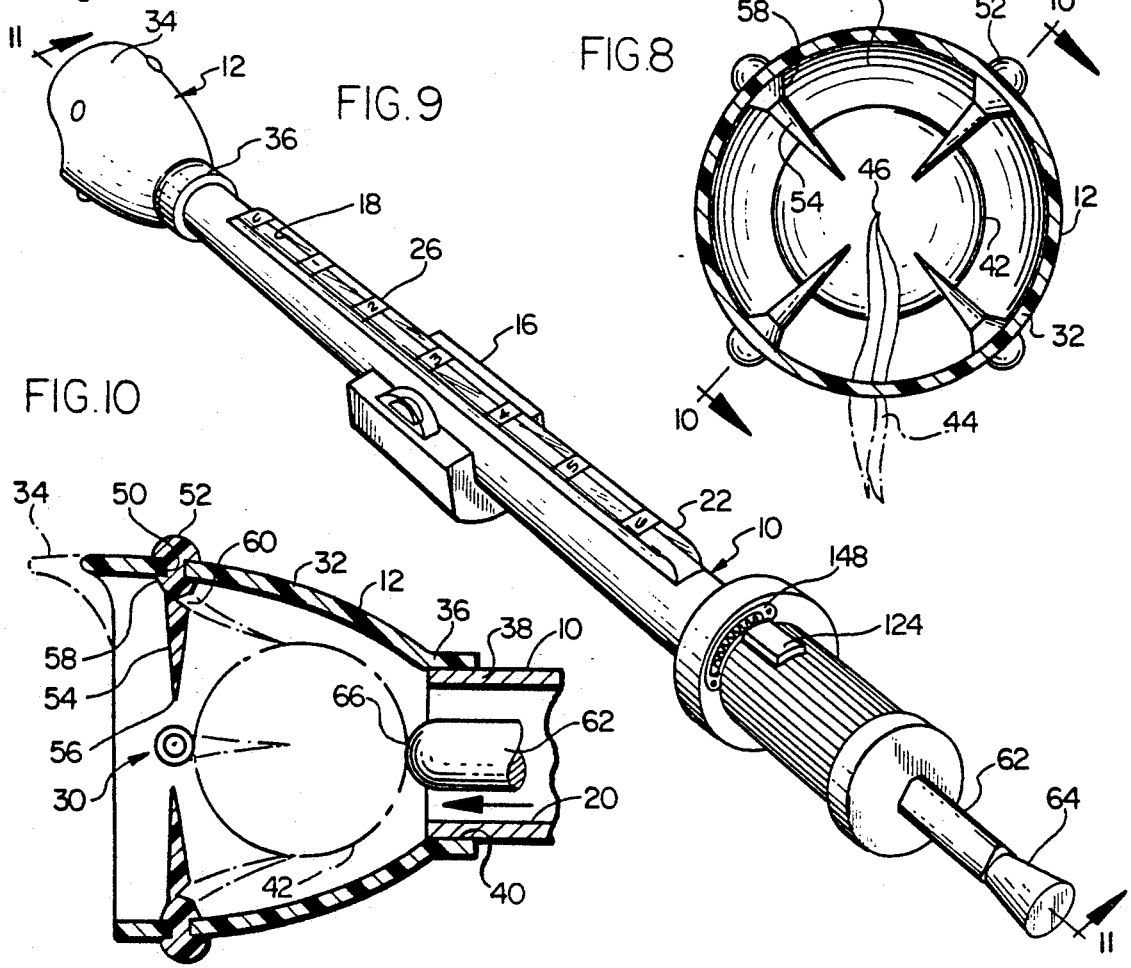
FIG.10

VARIABLE FORCE PROJECTOR AND CATCHER

FIELD OF THE INVENTION

The present invention is directed to a method and apparatus for providing a ball or projectile shooter. More particularly, the present invention is directed to a spring-operated ball or projectile shooter.

BACKGROUND OF THE INVENTION

It is common to use spring-operated devices to send projectiles into the air and catch them again. These devices are commonly used as toy guns; however, these toy guns lack an ability to control spring tension and to monitor the projectile's distance and direction. Children are the common users of these spring-operated toy guns. To avoid children being injured, it is desirable that these toy guns be provided with safety features which prevent premature or unintentional discharge.

This invention is directed to an improvement in spring-operated toys, such as disclosed in U.S. Pat. No. 3,897,061, in which is disclosed a ball or projector shooter which has the ability to control and monitor the projectile's distance and direction. This projectile shooter is easy to handle, lightweight and shoots the ball with reasonable accuracy and adjustable distance. The device provides a means to play a game wherein one shooter shoots his ball in flight with their ball shooters, like the game of trap or skeet. These games usually involve many individuals whom are usually children. Hence, the need for safety characteristics is desired.

The above-described shooter has a catch or trigger which is rotary so that its release is by means of a twisting force on the butt end of the barrel thus facilitating the release of the catch without a pull motion which would interfere with the elevation and direction adjustments. This activating motion, twisting the butt end, many times may produce an accidental and/or unintentional discharge of the projectile because it is easily done. This is especially true because the rotary trigger is gripped at all times when holding the shooter either during shooting or when at ease. For instance, if the shooter slips in the users hand, it may cause the grip to be twisted thereby discharging the shooter unexpectedly. The nature of the design is used to avoid having the shooter look similar to a gun. An advantage of the shooter is the way in which the shooter is held for playing the game. One hand is placed forward on the shooter and the other hand is placed on the grip; therefore, there may be a potential for harm when the shooter discharges at someone unexpectedly.

Additionally, when involved in competition, reloading of the shooter takes time, so if the shooter discharges prematurely before proper aim or preparation, the shot will usually be ineffective. This ineffectiveness of the shot can cause frustration and may even cost the player the game.

For safety requirements, it is desired that the shooter have a safety device preventing potentially dangerous and unintentional discharge of the projectile. Many times, children are the users of these shooter devices and additional safety features are most desirable to protect them. However, these additional safety features should not inhibit the ease of use and excitement involved in using the shooter. Overall, the shooter should prevent unintentional discharge for safety and competitive advantages.

SUMMARY OF THE INVENTION

The objective of this invention is to provide an automatic safety latch to a ball or projectile shooter to prevent unwanted and unintentional discharge. The projectile shooter here is easy to handle, lightweight and shoots the ball with reasonable accuracy and adjustable distance so that duplicating shots is made possible, particularly when some indication of the elevation or angle of the shot is given to the player. The device provides a means to play a game wherein one shooter shoots his ball along a trajectory and one or more other players shoot at the ball in flight with their ball shooters, like the game of trap or skeet. The presence of the tail on the ball gives visual impetus to the game and also increases the chances for a hit. In one aspect of the invention the catch or trigger is rotary so that its release is by means of a twisting force on the butt end of the barrel thus facilitating the release of the catch without a pull motion which would interfere with the elevation and direction adjustments. The position of both the elevation and force variables are clearly before the player at all times making it easer to duplicate shots with more accuracy.

More particularly, the actuating plunger is engaged by a rotatable sear at any one of a number of notches as it is pulled back in the tubular barrel. The barrel is provided with an elongated slot in the sidewall whereby the extent of retraction of the plunger against the actuating spring is made visible. The plunger is provided with indicia to show the extent of compression of the spring. The forearm has a gravity actuated pendulum suspended within a recess therein on its top side with a scale associated therewith to indicated the angle of the barrel above or below horizontal at the time of a shot.

The barrel has a cup or open-faced housing at the muzzle end which is adapted to receive the generally spherical soft projectile. A number of inwardly projecting flexible radial fingers are provided around the opening of the cup to retain the projectile in operable relationship with the striking end of the plunger. The cup and its fingers also serve as a receptacle by which a projectile shot by another gun can be caught as part of a game of skill. All of the parts are of simple design and are fitted together in a manner to make manufacture and assembly inexpensive. The absence of a stock or pistol grip makes the device more like a wand that is easily manipulated during loading and shooting.

BRIEF DESCRIPTION OF THE DRAWINGS

The present invention will be described in connection with the accompanying drawings, which illustrate the preferred embodiments and details of the invention, and in which:

FIG. 6 is a side plan view of the ball shooter with the projectile or ball shown in dotted lines;

FIG. 7 is a top plan view of the shooter;

FIG. 8 is a cross-sectional view of the catcher end of the barrel taken along the lines 8—8 of FIG. 7;

FIG. 9 is an isometric view of the shooter as seen from the player's viewpoint as he uses same illustrating the close association of the force and elevation indicators;

FIG. 10 is a cross-sectional view taken along the lines 10—10 of FIG. 8;

DETAILED DESCRIPTION OF THE INVENTION

Figure 1:
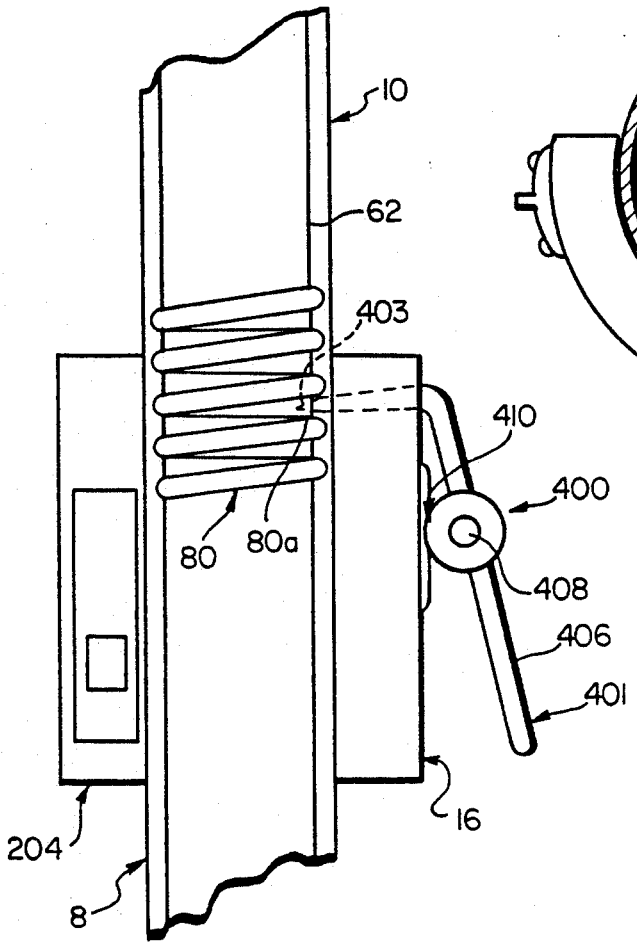
FIG. 1 is a plan view of a shooter with a safety catch means constructed in accordance with a first embodiment of the invention.
Figure 2:
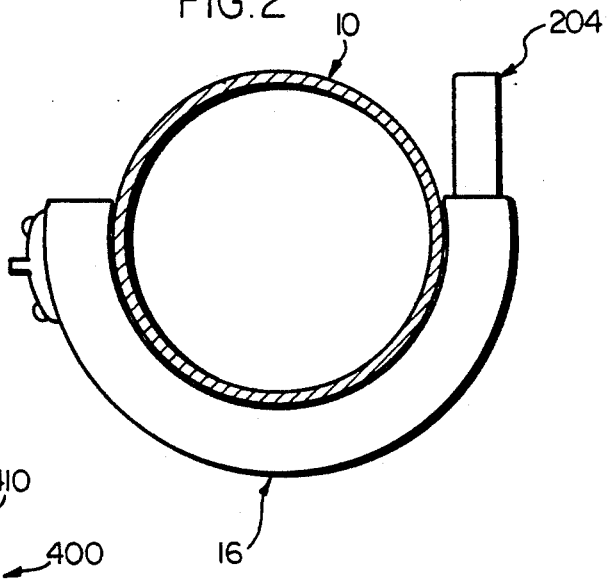
FIG. 2 is an enlarged cross-sectional view of the forearm on the barrel having the safety catch means of FIG. 1.

As shown in the drawings for purposes of illustration, the invention is embodied in a shooter 8 of the kind shown in U.S. Pat. No. 3,798,061, although the shooter may be in other forms. Shooters of this kind have an elongated barrel or barrel member 10 having at one end a catcher or housing member 12 to hold a projectile 42 for shooting from the catcher member 12 and have an opposite or breech end at which is located a trigger assembly 14. A spring 80 in the form of an elongated coiled spring is provided in the barrel to provide the force, after compression of the spring 80, to actuate a sliding plunger 62 in the barrel to travel forwardly in the barrel to impact the projectile 42 and project or shoot the projectile from the housing member 12. The spring 80 is cocked by pulling a handle 60 to pull the spring rearwardly and thereby compressing the coils of the spring 80. To shoot the projectile, the trigger assembly 14 is actuated such as by twisting the trigger assembly to disengage a sear 156 from a notch 70 in the plunger rod 62.

It is desirable that the trigger not be accidentally or unintentionally actuated to shoot the projectile 42. The accidental or unintentional operation of the trigger will allow the projectile to be shot and may accidentally hit a person.

In accordance with the present invention, there is provided a safety catch means 400 which must be first operated before operation of the trigger assembly is operative to shoot the projectile 42. That is, operation of the trigger assembly without a concomitant operation of the safety catch means 400 will not discharge the shooter projectile 42. On the other hand, operation of the safety catch means concomitantly with operation of the trigger assembly 14 will shoot the projectile 42. Thus, there is required two deliberate acts to shoot the projectile.

Figure 5:
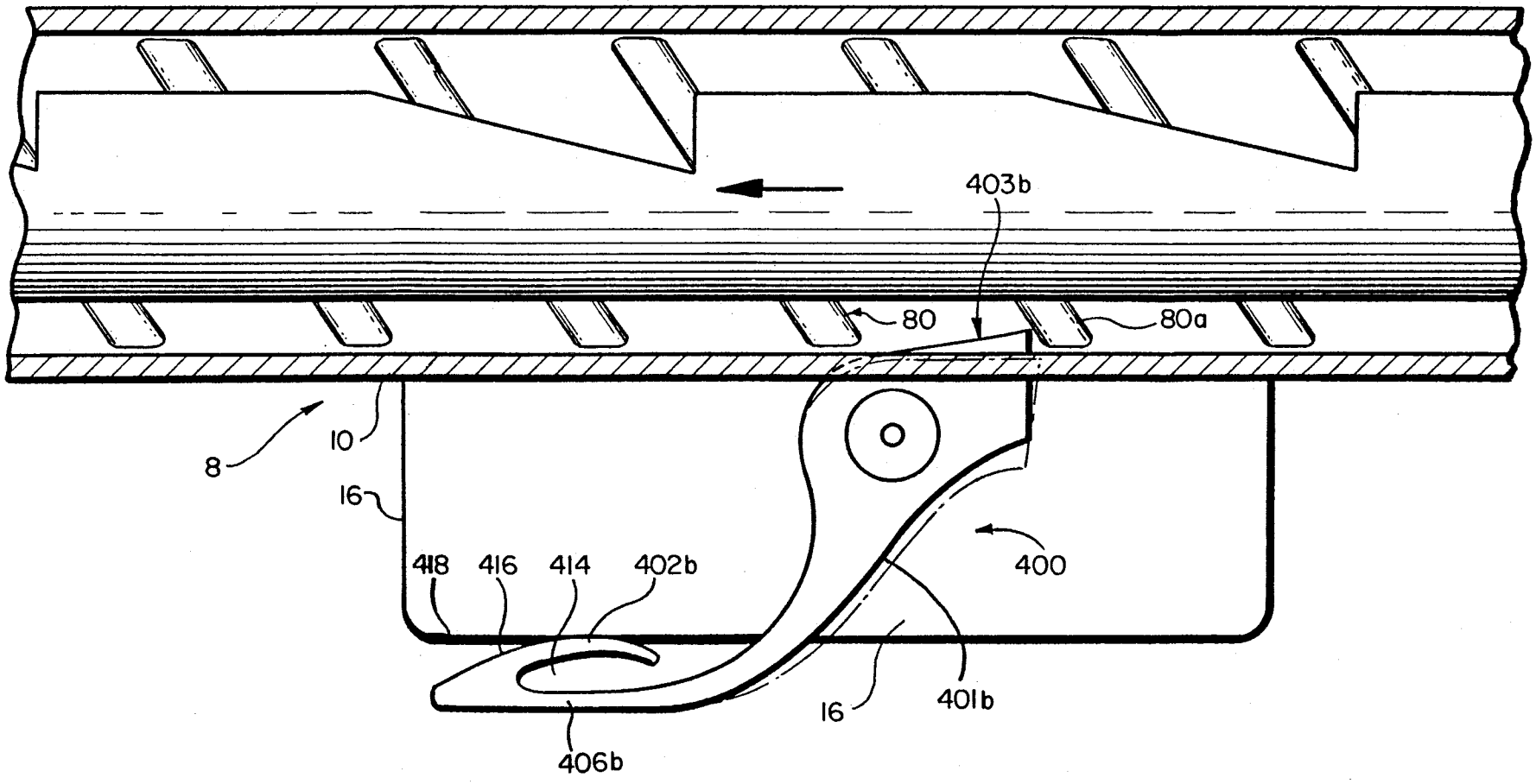
FIG. 5 is a partially sectioned viewed of a shooter barrel with a safety catch means constructed in accordance with another embodiment of the invention.

To further assure that the two simultaneous acts are intentional, it is preferred that the safety catch means 400 be biased to its operable position to prevent shooting, and that the safety catch means must be held against this biase force by manual pressure on the catch member at the same time that the trigger is operated in order to shoot the projectile 42. Preferably, this is achieved with a relatively inexpensive addition to the shooter 8. To this end, the safety catch means preferably is in the form of a pivotally-mounted catch element 401 (FIG. 1) which is biased by a spring 402 which must be overcome in order to disengage a nose 403 on the latch element from latching engagement with a coil 80*a* of the power spring 80. Alternatively, as shown in FIG. 5, the latch element 401*b* may be biased by an integral spring 402*b* on the latch element to rotate nose 403*b* into latching engagement with the coil 80*b* of the power spring 80.

In order to shift the nose 403 (FIGS. 1 and 3) from engagement with the power spring 80, the gun operator engages handle end 406 of the catch element 401 and pivots the same about a pivot pin 408 on which the catch element is mounted. The catch element is preferably in the form of a small lever that may be readily operated by a single or several fingers of the hand placed on the forearm member 16 and is located opposite the cover 204 for the pendulum that represents the angle from the level at which the toy shooter 8 is aimed. An opening 407 (FIG. 4) is formed in the forearm 16 and in the barrel 10 to allow the catch element nose 403 to engage the coil 80*a* of the power spring 80. The safety catch handle projects outwardly of the forearm, and when squeezed towards the forearm lifts the nose from the power spring coil to allow the spring to expand and slide the previously detented sliding plunger 62 forwardly with a great acceleration to impact the projectile 42 to shoot the same.

Figure 3:
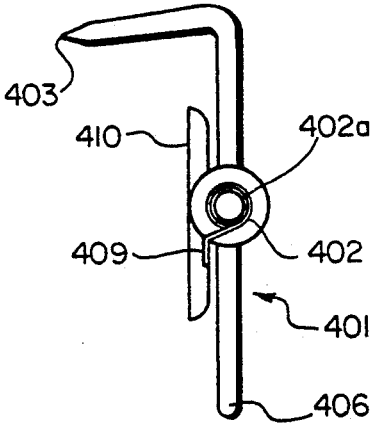
FIG. 3 is a side elevational view of the safety catch means of FIG. 1.
Figure 4:
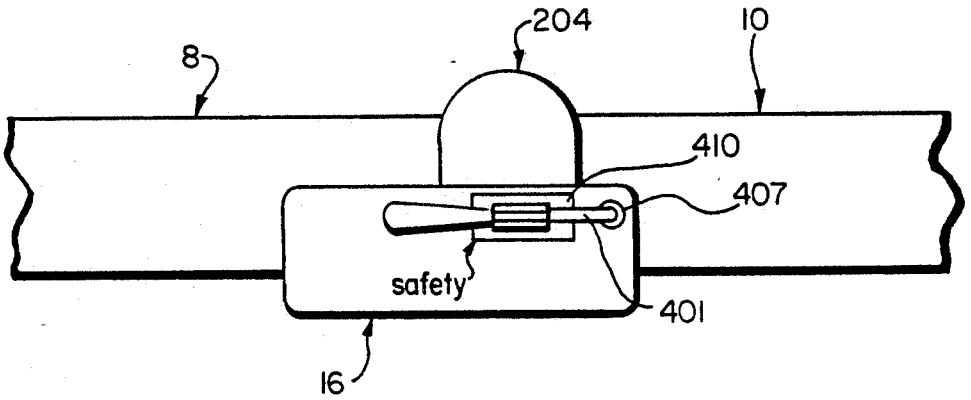
FIG. 4 is a reduced-size, side elevational view of the safety catch means of FIG. 1.

As best seen in FIG. 3, the spring 402 may be a small coiled torsion spring having one end 402*a* fixed to the pivot pin 408 and thereby, to the catch element 401 with the other end of the torsion spring fixed to a small block 410 which mounts the safety catch means to the stationary forearm 16. In the embodiment of FIG. 5, the spring is in the form of a leaf 402*b* which is bent back beneath the handle portion 406*b*, which will be forced manually by the gun operator toward the handle portion to decrease a space 414 therebetween. Herein, the leaf spring 402*b* has a curved surface 416 to slide along a surface 418 of the stationary forearm 16. The catch element 401*b* may be made as a one-piece molded piece of plastic with its integral leaf spring 402*b* and detent nose 403*b* on opposite ends thereby providing a very inexpensive additional piece to be added to the toy shooter without expensive and/or complicated additions or revisions to the shooter.

Figures 11, 12, 13, 14, 15, 16:
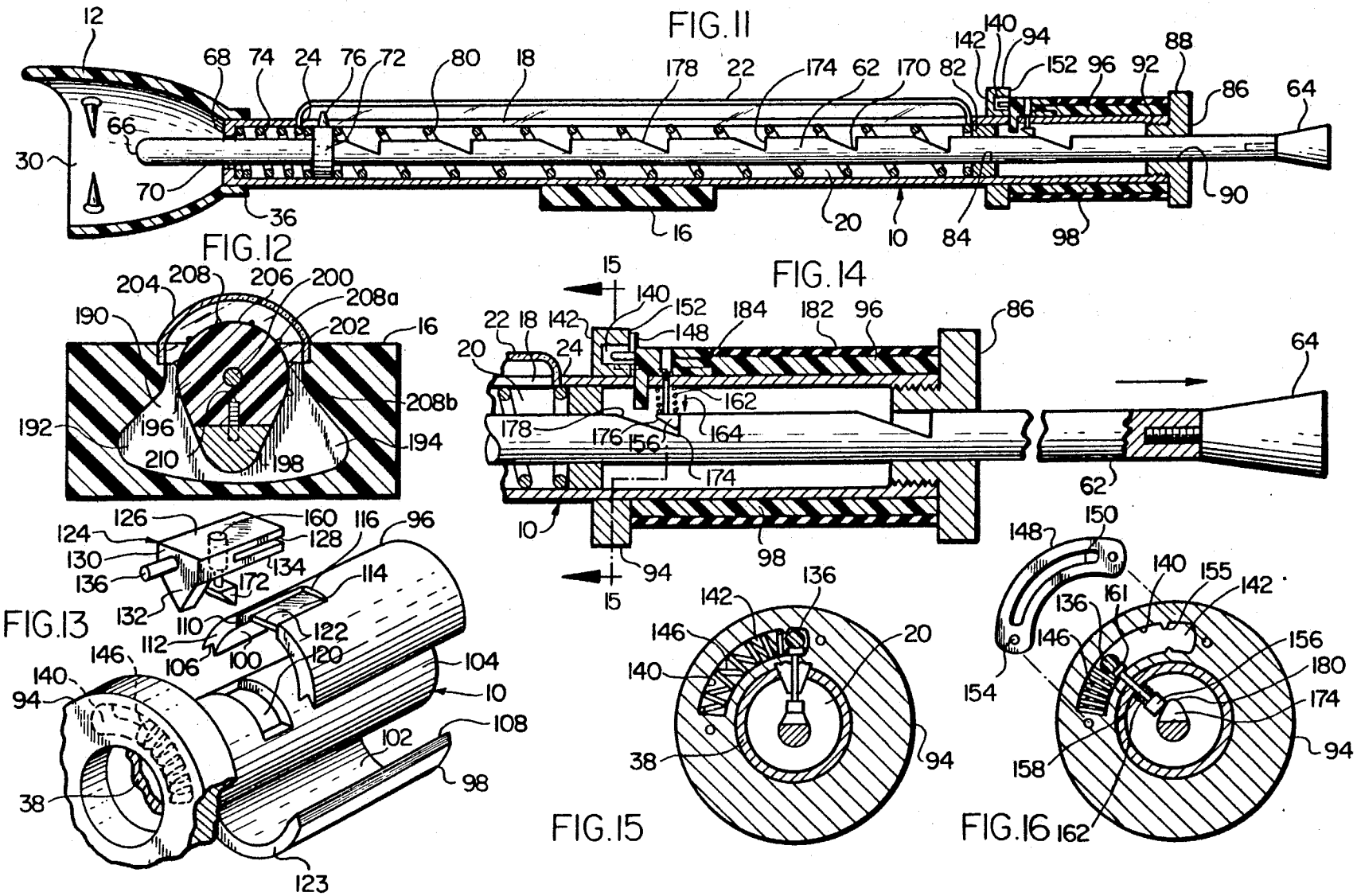
FIG. 11 is a longitudinal cross-sectional view taken along the lines 11—11 of FIG. 9.
FIG. 12 is a cross-sectional view of the elevation indicator taken along the lines 12—12 of FIG. 7.
FIG. 13 is a fragmentary exploded view of the rotatable buzzer handle at the butt end of the barrel.
FIG. 14 is an enlarged fragmentary cross-sectional view of the butt end of the barrel to show the details of the rotatable trigger arrangement.
FIG. 15 is a cross-sectional view along the lines 15—15 of FIG. 14.
FIG. 16 is a view like FIG. 15 showing the trigger or catch in the release position and also indicating the relative position of the cover plate for this part of the shooter.

Turning now to a more detailed description of the shooter 8, it will be seen that the shooter has an elongated slot 18, as best seen in FIGS. 7 and 8 that extends a substantial length of the barrel and communicates with an internal bore 20 thereof as shown in FIG. 11. Returning to FIGS. 6, 7, and 8, the elongated slot 18 forms a retaining edge for an elongated transparent cover or window 22. The window 22 may have a peripheral edge 24 affixed thereto within the elongated slot 18 by means of an adhesive. A set of spaced indicia or numerals 1-6, indicated at 26 on the elongated transparent cover 22 are provided to show the relative force being applied to the projectile as will be described.

Referring particularly to FIGS. 8 and 10, it is seen that the catcher housing member 12 is cup-shaped having a flared open end 30 defined by a wall 32 which also defines an extended lip 34 at a top portion of the open end 30. The catcher housing member 12 has a circular base flange 36 that encompasses an open end of a wall 38 of the tubular barrel member 10. A juncture 40 of these parts can be threaded or represent an adhesive interface. Alternatively, the circular base flange 36 can be press-fitted or threaded onto the wall 38.

The projectile 42 is shown in FIG. 8 as being either a soft rubber or soft plastic ball of hollow construction. Alternatively, the projectile 42 can have a hard core surrounded by a spherical layer of soft rubber or soft plastic. The purpose is to provide a projectile which will be fairly stable in flight yet will not cause any injury if it strikes a person. The ball is provided with a tail or flag 44 of any desired color fastened thereto at one pint 46 by any suitable means. The tail 44 can be provided with a knot at one end which is molded deep into the body of the ball at the time of production so that there is not tendency for it to tear out.

The ball 42 is smaller in diameter that the effective diameter of the open end 30 of the catcher housing member 12 so that a radial space 48 therearound is provided which is about the same as the radius of the ball. In other words, the diameter of the ball is about one-half the diameter of the open end 30. These dimensions are subject to variation. These dimension are subject to variation and a larger catcher housing member 12, in relation to the size of the ball 42 can be used, particularly for use by children. These dimensions further provided for easy ejection of the ball 42 from the catcher housing member 12 during discharge. Moreover, these dimensions enable the catcher housing member 12 to catch the ball 42 while it is travelling in the air.

The wall 32 of the catcher housing member 12 is provided with four or more equally spaced holes 50 to receive each a head 52 of a flexible tapered finger 54. The flexible tapered fingers 54 have each a tip end 56 which are separated from each other by an amount less than the diameter of the ball 42. The heads 52 are larger than the holes 50. Each finger 54 is reduced in size just below the head 52 so as to snap-fit therein and then each finger is again enlarged and tapered therefrom as best seen in FIG. 10. The fingers 54 are made from a flexible plastic or rubber so that the fingers can be readily installed by inserting the tip end 56 in the holes 50 from the outside and pressing the fingers inwardly until the finger snap-fits through the hole 50 and into the relationship shown in FIG. 10. The heads 52 are rounded so that no harmful projections are on the outside surface of the catcher housing member 12.

Each finger 54 is flexible so that the ball 42 upon being received in the catcher housing member 12 presses past the fingers 54 by its own weight or inertia and comes to the broken-line position shown in FIG. 10 with the fingers 54 still in contact with the surface of the ball to hold same in axial alignment with the bore hole 20 of the tubular barrel 19. In FIG. 8 it is seen that the fingers 54 are conical in shape. In order to provide less resistance to rearward thrust and greater ease of release of the ball 42 without loss of the axial orientation, the fingers 54 are notched, as 60 on their back sides. The notches 60 can be adjusted in size in relation to the body diameter of the fingers to provide the desired degree of holding, snapback and orienting action. The notches 60 can also be omitted. The fingers 54 are make of tough elastomer or rubber composition sa as to withstand shock and repeated flexing.

The tubular barrel 10, defining a longitudinal bore 20, housed a plunger rod 62, as best shown in FIG. 6 having at one end a handle 64 extending from the end opposite the catcher housing member 12. At the catcher housing member 10, a ram or buttress 66 extends through the circular base flange 36 into the catcher housing member 12. The buttress 66 is rounded and adapted to strike the ball to cause it to fly from the catcher housing member 12.

The tubular wall 38 of the tubular barrel 10 has a radial inner muzzle flange 68 defining an opening 70 at the catcher housing member 10 end to receive the buttress 66 in freely sliding and spaced relationship. Spaced from the buttress 66 there is provided an integral radial guide flange 72 attached to the plunger 62. The integral radial guide flange 72 has an outside diameter slightly less than the inside diameter of the bore 20 so as to slide freely therein.

The flange 68 provides a seat for a shock absorber-type spring 74. The spring 74 is a coiled spring encompassing the buttress 66 and seated at its other end against a forward wall of the integral radial guide flange 72. The spring 74 can be affixed as desired to either the flange 68 or to the flange 72 or not be attached to either flange.

A combination guide and indicator member 76, preferably made as a separate part from the integral radial guide flange 72, extends from its top side within and spaced from the longitudinal slot 18. This indicator member 76 and the flange 72 can be of a different color than the tubular barrel 10 so as to be readily visible through the plastic window 22 as a quick reference to the position of the plunger 62 in the tubular barrel 10 and to show whether the shooter is cocked or not. The indicator member 76 can be omitted.

The main spring 80, also a coil spring, encompasses a substantial part of the length of the plunger 62 from the flange 72 to a breech plug 82. The breech plug 82 is made as a separate part as well as the indicator member 76 so that the plunger 62 and the spring 80 can be assembled in the tubular barrel 10. Once these parts are in place the indicator member 72 can be attached and the spring 80 held under tension while the breech plug 82 is fitted in place. This member can be cemented into position or held by screws affixed through the wall of the tubular barrel 10.

The breech plug 82 has a central bore 84 which engages the plunger 62 in a close-fitting sliding engagement. The plunger 62 is longer than the tubular barrel 10 so that the handle 64 protrudes from the breech end at all times. A space between the indicator-guide 76 and the forward or muzzle end of the slot 18 is large enough that when the plunger 62 butts the shock absorber spring 74, it does not strike this end of the slot.

A second guide for the plunger 62 is provided by an end cap 86. The end cap 86 has a flange 88 and a bore 90 which slidably receive the plunger 62. This end cap 86 can be attached an end of a panel 10 by screw threads 92, shown, or by any other means.

The tubular barrel 10 carries an external collar 94 about opposite the breech plug 82. The collar 94 is about the same outside diameter as the flange 88. Trigger housing parts 96 and 98, as best shown in FIG. 8, are defined through these parts. The trigger housing parts 96 and 98 are generally arcuate in shape and of larger diameter than the tubular barrel 10.

The trigger housing members 96 and 98 are the same length and each has an inner arcuate wall 100 and 102, respectively, which generally conforms in curvature with an outer surface 104 of the tubular barrel 10. Additionally, each trigger housing member corners half of the circumference of the tubular barrel. These parts are further cemented in place or otherwise attached to the barrel. To facilitate permanence of the trigger housing, the top housing member 96 has grooved edges 106, on each side, which engage tapered edges 108 of the bottom housing member 98.

The top housing member 96 has a rectangular notch 110 opening to a forward edge 112 and having an intermediate wall 114 thereon which defines a rectangular depression having an end wall 116 in the top forward edge of the housing. The intermediate wall 114 is also spaced from the inner arcuate wall 100 of the housing member 96. The intermediate wall 114 is thinner than the effective thickness of the wall of the housing member 96.

The wall 38 of the tubular barrel 10 has a rectangular arcuate opening 120 therein behind and spaced from the external collar 94.

The rectangular arcuate opening 120 is opposite the notch 110 defined by an edge 122 of the intermediate wall 114 when the housing member 96 is in place on the surfaces 104 of the tubular barrel 10 and the collar 94 abuts against the end surface 112 and another surface 113 of the trigger housing members 96 and 98.

A trigger member 124 has a block-like base 126 with a slot 128 on the back edge. A front wall 130 has a guide tip and stop member 132 extending below a bottom wall 134 and also a tab 136 extending out longitudinally of the base 126. The collar 94 has an arcuate slot 140 that is open to the rear having an enclosed front wall 142. A coil spring 146 is housed within the arcuate slot 140 by means of a cover plate 148 having an arcuate slot 150 and engaged against a rear wall 152 of the collar 94 by means of screws or the like (not illustrated) that would engage through holes 154 in the cover plate 148. The coil spring 146 is thus completely housed within the slot 140.

The trigger member 124 is installed by engaging the slot 128 over the web wall 114. This brings the front wall 130 in the plane of the edges 112 and 113 and the top and bottom depressions over the wall 114 are filled. The surfaces of the block 126 can be curved so that when the trigger member 124 is assembled, it conforms with the exterior and interior wall curvature of the trigger housing 96.

The trigger has the spring-loaded sear 156 with the shank 158 extending into the bore hole 160 of the base 126. The spring 162 biases the sear 156 downwardly in the direction of the arrow 164. The sear extends into the slot 128 just behind the stop member 122 which impinges against the front edge 166 of the slot in sliding rotational relationship. In this position the tab 136 extends into the arcuate slot 140 and the trigger assembly 96–98 and 124, which is rotatably carried on the surface, or breech 104 of the barrel 10 is biased by the spring 146 so that the sear is upright and is biased into the spaced notches 170 with its flat back side 172 against the straight edge 174 of a notch. The leading surface 176 of the sear 156 is leveled so as to cam against the sloped surfaces 178 of the notches 170.

The plunger rod 62 is slightly out of round to present a narrow plate 180 at the top of each notch. The assembly includes a hand grip 182 which encompasses the trigger members 96–98. This hand grip will be notched at 184 to encompass the raised edge of the trigger 124. Accordingly, as the plunger 67 is pulled back by the handle 64, the sear 156 will drop into each notch 170 in succession, and the indicator 76 will come into registry with the members 1–6, indicating the number of notches of pull. The trigger then assumes the position shown in FIG. 10. Then by turning the grip 182, between the flange 94 and the end flange 88, the sear is rotated off-center as shown in FIG. 11, against the trigger spring 146, and the cam 62 is released.

Referring to FIG. 7, the grip 16 has the cavity 190 with the fore and aft undercut positions 192 and 194 to accommodate the pendulum 196, having the weight 198, and pivoted on the pin 200, that extends transverse the grip 16. The top part of the cavity 190 has the off-set periphery 202 to receive the edge of the transparent arched cover member 204. The top surface 206 of the pendulum is rounded circumferentially with the axle 200 and bears the raised indicia 208 to show the relationship of the longitudinal axes of the barrel 10 with the horizontal.

Since the ball shooter is held in two hands at about waist level, the angle of the shooter's eye to the indicia 208 will be less than vertical. Accordingly, the registry of a particular indicia **208*a* on the back sides of the pendulum with the back edge of the cover 204 can represent the level position of the shooter. As the breech end is lowered the next indicia 208*b* will come into view and tell the shooter the angle of the shot. The indicia 208 can be color-coded and a reference line can be provided on the cover 204 or only a part of it made transparent to establish a line of sight to the indicia. The weight 198 is held by any means such as the screw 210 that is embedded between these parts. Other means for fastening the weight 198** can be used.

The pendulum 196 can be mounted on the barrel and the forearm 16 omitted. Also, the pendulum can be elevated so that it registers from the side rather than the top, more in line with the shooter's line of sight along the barrel.

The operation of the ball shooter is quite simple. The plunger rod 62 is pulled against the spring 80 by means of the handle 64 as the barrel is gripped by the forearm 16. The sear 156 engages one of the notches 170 in the plunger rod and holds it in cocked position. The ball 42 is inserted against the radial fingers 54, as shown in FIG. 5. The barrel is aimed at the desired elevation indicated by the pendulum 196, and the trigger assembly 14 is twisted. This disengages the sear to the position shown in FIG. 11 and the plunger drives the ball from the cup 12.

What is claimed is:

1. A toy projectile shooter for shooting a projectile comprising:

an elongated tubular barrel having a breech end and having a projectile receiving muzzle end being flared and defining an open-ended cup larger that said projectile;

a trigger assembly at said breech end;

a spring-loaded plunger rod reciprocatably mounted within said tubular barrel movable between a cocked position in which the plunger rod is biased to move toward the projectile and an operating position in which the plunger rod impacts the projectile and shoots the projectile from the muzzle end, a spring in the barrel adapted to be compressed to store spring energy when the plunger rod is in its cocked position and to apply force to the plunger rod to move it to impact the projectile, a trigger assembly positioned along the barrel for holding the plunger rod in its cocked position and for releasing the plunger rod for travel to impact and to shoot the projectile, and a safety catch operable to hold the plunger rod in its cocked position until there is an operation of both the safety catch and the trigger assembly to allow the plunger rod to travel to impact and shoot the projectile.

2. A toy projectile shooter in accordance with claim 1 in which the safety catch engages the spring and holds the spring compressed to prevent an accidental shooting of the projectile by the trigger assembly without the safety catch being first disengaged from the spring.

3. A toy projectile shooter in accordance with claim 2 in which the safety catch includes a catch element pivotally mounted adjacent the trigger assembly and having a nose thereon to engage the spring, a safety catch biasing means biasing the nose of the catch element into engagement with the spring, and pivoting of the catch element against the urging of its biasing means disengaging the nose of the catch element from holding the spring against expansion.

4. A toy projectile shooter in accordance with claim 3 in which the safety catch biasing means comprises an integral deflectable portion of the catch element that is deflected with rotation of the catch element.

5. A toy projectile shooter in accordance with claim 3 in which the safety catch biasing means comprises a coiled spring separate from the catch element.

6. A toy projectile shooter comprising:

an elongated tubular barrel having a projectile receiving muzzle end and a breech end; a projectile;

said muzzle end being flared and defining an open ended cup larger than said projectile and includes:

a series of circumferential spaced flexible members extending radially inward from the wall thereof;

the axial distance of said flexible members from said muzzle end of said barrel being substantially equal to the diameter of said projectile and the length of said flexible members in relation to the diameter of said walled cup being such that said projectile passes therethrough with said flexible members retaining said projectile in spaced relationship aligned with said plunger rod by tangential contact with said projectile;

a trigger assembly at said breech end;

a spring-loaded plunger rod reciprocatably mounted within said tubular barrel;

one end of said plunger rod being forcefully extendable through said muzzle end of said barrel;

the other end of said plunger rod extending in operable relationship with said trigger assembly and having a handle end extending beyond said breech;

stop means at each end of said barrel to contain said spring-loaded plunger rod;

means along said tubular barrel to indicate said selected biased positions of said plunger rod therein whereby the force applied to projectile contained in said muzzle end is controlled upon release of said trigger assembly;

a gravity-sensitive member carried by said tubular barrel;

means connected to said gravity-sensitive member to indicated the longitudinal angular elevation of said barrel;

said trigger assembly includes a detent extending radially into said tubular barrel for registry with said catch means on said plunger rod to hold said plunger rod at selected positions of bias;

means to move said detent circumferentially independent of said plunger rod to and from said positions of registry; and an automatic safety latch means for disabling the plunger rod against travel to a position to impact and shoot the projectile by operation of the detent of the trigger assembly, operation of the safety latch means enabling the shooting of the projectile with operation of the trigger assembly.

* * * * *